US007821766B2

(12) United States Patent
Brundula

(10) Patent No.: US 7,821,766 B2
(45) Date of Patent: Oct. 26, 2010

(54) SYSTEMS AND METHODS FOR PULSE DELIVERY

(75) Inventor: Steven N. D. Brundula, Chandler, AZ (US)

(73) Assignee: TASER International, Inc., Scottsdale, AZ (US)

( * ) Notice: Subject to any disclaimer, the term of this patent is extended or adjusted under 35 U.S.C. 154(b) by 749 days.

(21) Appl. No.: 11/737,374

(22) Filed: Apr. 19, 2007

(65) Prior Publication Data

US 2008/0259520 A1 Oct. 23, 2008

(51) Int. Cl.
*F41C 9/00* (2006.01)

(52) U.S. Cl. ..... 361/232; 42/1.08

(58) Field of Classification Search ..... 361/232; 42/1.08; 102/502

See application file for complete search history.

(56) References Cited

U.S. PATENT DOCUMENTS 3,699,388 A 10/1972 Ukai
4,582,063 A 4/1986 Mickiewicz et al.
4,644,439 A 2/1987 Taarning
5,124,905 A 6/1992 Kniepkamp
5,215,066 A 6/1993 Narishige et al.
5,891,172 A 4/1999 Stendahl
5,962,806 A 10/1999 Coakley
6,937,455 B2 8/2005 Krichtafovitch et al.
7,057,872 B2 6/2006 Smith
7,280,340 B2 * 10/2007 Smith et al. ..... 361/232
2007/0079538 A1 * 4/2007 Smith et al. ..... 42/1.08
2008/0007887 A1 * 1/2008 Weaver ..... 361/232

* cited by examiner

*Primary Examiner*—Danny Nguyen
(74) *Attorney, Agent, or Firm*—William R. Bachand

(57) ABSTRACT

An apparatus for interfering with locomotion of a target by conducting a current through the target includes according to various aspects of the present invention a transformer, a capacitance, a charge detector, and a processor. The transformer has a secondary winding that is coupled to the target to provide the current. The capacitance is in series with the secondary winding and is charged to a voltage. The charge detector detects a charge provided through the target by the capacitance and the secondary winding. The processor sets the voltage (e.g., for charging for a next pulse) responsive to the charge detected by the charge detector.

35 Claims, 4 Drawing Sheets

400

TABLE OF CONDITIONS

| | CHARGE DETECTED THIS PULSE | ADJUSTMENT FOR NEXT PULSE |
|---|---|---|
| 402 | NO ARC FORMED (E.G., LESS THAN THRESHHOLD AMOUNT) | NO CHANGE TO ENERGY STORED |
| 404 | UNDER GOAL (E.G., ABOUT B) | INCREASE ENERGY STORED TO INCREASE CHARGE DELIVERED TO TARGET |
| 406 | AT GOAL (E.G., ABOUT B+C) | REPEAT ENERGY STORED AT EXISTING AMOUNT |
| 408 | OVER GOAL (E.G., B+C+D) | DECREASE ENERGY STORED TO DECREASE CHARGE DELIVERED TO TARGET |

FIG. 4

SYSTEMS AND METHODS FOR PULSE DELIVERY

FIELD OF THE INVENTION

Embodiments of the present invention relate to systems and methods for providing pulses from an electronic weapon.

BACKGROUND

Conventional electronic weapons provide a stimulus signal as a series of pulses to a load. An amount of charge delivered by each pulse of the stimulus signal varies within manufacturing tolerances of the weapon and varies for a wide variety of loads that may be presented to the weapon. The load may change during stimulation. Accordingly, stimulus to the load is somewhat non-uniform over a series of pulses intended to be uniform from one load to another or from one weapon to another of a common type.

In some applications it is desirable to increase uniformity of pulses experienced by a load, for example, to provide a more accurate record of stimulus delivered, to use minimum energy to effect stimulus, and to conserve energy expended by the weapon as a whole. Unless energy is conserved, the period of time an electrical weapon is available for use cannot be extended. Without the present invention, these benefits cannot be realized with conventional technology.

Implementations according to various aspects of the present invention solve the problems discussed above and other problems, and provide the benefits discussed above and other benefits as will be apparent to the skilled artisan in light of the disclosure of the invention made herein.

SUMMARY

An apparatus for interfering with locomotion of a target by conducting a current through the target includes, according to various aspects of the present invention, a transformer, a capacitance, a detector, and a processor. The transformer has a secondary winding coupled to the target to provide the current. The capacitance is in series with the secondary winding. The detector detects a quantity of charge provided by the capacitance and the secondary winding. The processor controls recharging of the capacitance in response to the detector.

A method, according to various aspects of the present invention, conducts a current through a target and is performed by an apparatus. The method includes, in any practical order: charging a capacitance in accordance with a goal; discharging the capacitance, monitoring a charge of the current; and adjusting the goal. Discharging provides the current that is monitored. The goal is adjusted in response to the current.

Another method, according to various aspects of the present invention, conducts a current through a target and is performed by an apparatus. The method includes, in any practical order: charging a capacitance; discharging a capacitance in accordance with a goal; monitoring a charge of the current; and adjusting the goal. Discharging provides the current that is monitored. The goal is adjusted in response to the current.

Another method, according to various aspects of the present invention, is performed by an apparatus that conducts a current through a target. The method includes, in any practical order: storing energy; releasing stored energy; monitoring the current; and repeating releasing energy in response to a result of monitoring.

A memory, according to various aspects of the present invention includes: indicia of a prescribed series of pulses; and instructions for adjusting a current through a target in accordance with the indicia.

BRIEF DESCRIPTION OF THE DRAWINGS

Embodiments of the present invention will now be further described with reference to the drawing, wherein like designations denote like elements, and:

FIG. 4 is a table of conditions detected and adjustments made by the method of FIG. 3.

DETAILED DESCRIPTION OF THE PREFERRED EMBODIMENTS

Figure 1:
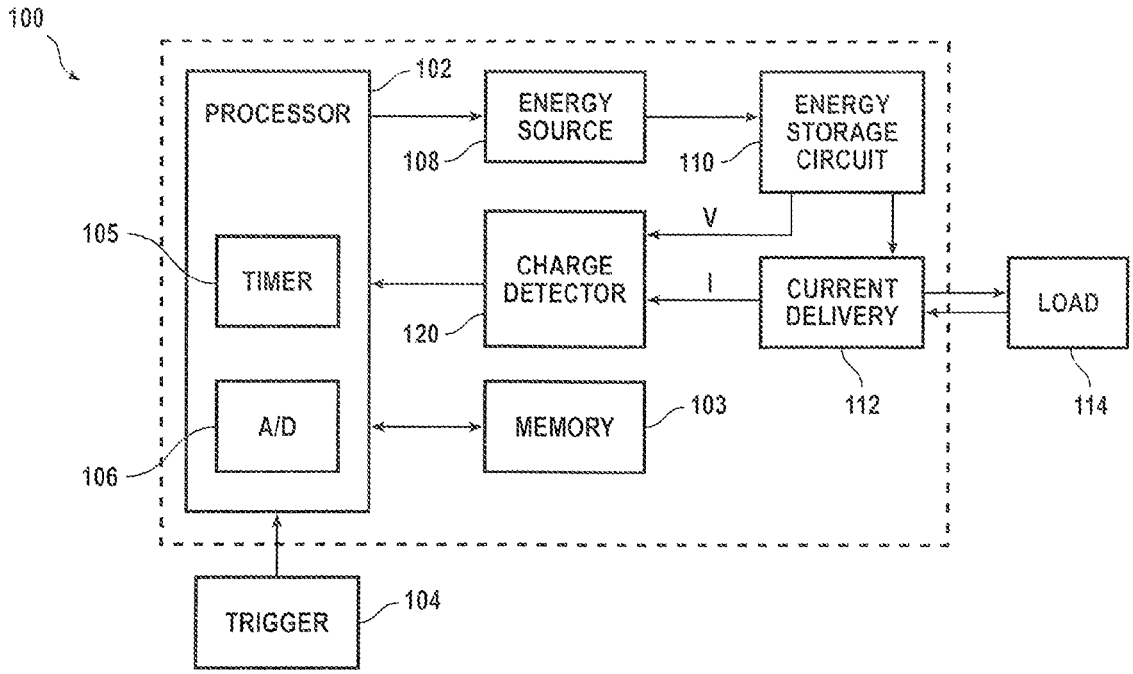
FIG. 1 is a functional block diagram of an apparatus for delivering pulses to a load, according to various aspects of the present invention.

Interfering with locomotion of a human or animal target may be accomplished, according to various aspects of the present invention, by delivering a plurality of current pulses through the target. An apparatus that serves this purpose May be an electronic weapon. Electronic weapons include any weapon that passes a current through the target, for example, a hand-held weapon (e.g., stun gun, baton, shield); a gun, installation, or mine that shoots wire tethered darts; a wireless projectile launched (e.g., by a hand-held gun, installation, or mine) toward the target; or a restraint device (e.g., an electrified belt, harness, collar, shackles, hand cuffs) affixed to the target.

An apparatus that interferes with locomotion of a human or animal target, according to various aspects of the present invention, delivers pulses of current through the target and may further record the date and time of delivery.

An individual such as a police officer, a military soldier, or a private citizen may desire to interfere with the voluntary locomotion of a target. Locomotion by a target may include movement toward and/or away from the individual by all or part of the target. An individual may desire to interfere with locomotion by a target for defensive or offensive purposes (e.g., self defense, protection of others, defense of property, controlling access to an area, threat elimination).

Interference with locomotion of a target may include using pain compliance to discourage motion and/or disrupting voluntary control of skeletal muscles. Disrupting, voluntary control of skeletal muscles may halt voluntary locomotion by the target.

Effective delivery of current though a load (including a target) may depend on a degree of matching between an impedance of a delivery circuit and an impedance of the load. Delivery circuit impedance may vary within manufacturing tolerances and the circuit's components. Load impedance may depend on the target, environmental conditions, target behavior, and/or circuit formation from the delivery circuit of the apparatus through the target.

A pulse of energy, according to various aspects of the present invention may include an electrical signal having more than one effective portion separated by portions designed to have little or no effect. An effective portion may have any suitable pulse width, pulse charge, voltage and/or current. Each effective pulse causes a contraction of skeletal muscles. An effective rate of pulses may cause a tetanus type reaction of voluntary skeletal muscles that halts locomotion by the target.

Delivering prescribed (e.g., uniform) pulses, according to various aspects of the present invention, may improve effectiveness of halting locomotion. Effectiveness of pulse delivery depends on, inter alia, characteristics of a path for delivery (e.g., load conditions), electrical properties of components used in the apparatus, and operating conditions of the apparatus. Effectiveness of pulse delivery (e.g., each pulse being effective) may be accomplished by compensating for inter alia variations of load conditions, component values, and operating conditions.

Load conditions may vary according to atmospheric conditions (e.g., rain, humid, dry, hot, cold), target position, target movement, electrode (e.g., probe) placement with respect to a target, variations over time in electrode placement (e.g., target moves, electrode becomes embedded, electrode falls off target), target type (e.g., human or animal), target coverings (e.g., clothes), dimension of an air gap between an electrode and the target, and/or ionization of an air gap between an electrode and the target.

Electrical properties of components may vary according to well known factors including component type, manufacturing process, material type, age, and temperature. Some components may have properties (i.e. values) within relatively wide tolerances.

Operating conditions may include, temperature, humidity, age of weapon, battery conditions, duration of a particular use, number of pulses delivered, number of pulses delivered with ionization energy, and frequency of pulse delivery.

According to various aspects of the present invention, an apparatus for interfering with locomotion of the target, for example system 100 of FIGS. 1-5, may deliver prescribed (e.g., uniform) pulses into a relatively wide range of load conditions, with variation of component values, and variation of operating conditions. Delivery of prescribed pulses increases the effectiveness and predictability of the effects of the pulses on the target.

System 100 of FIG. 1, delivers pulses into load 114. Load 114 may include a human or animal target as described above in a conventional environment (e.g., accounting for clothing, weather, movement, body chemistry, and aggressiveness). Apparatus 100 may further record a date and time of delivery (e.g., a trigger pull). A record of a trigger pull may indicate that a series of pulses was delivered. A record of delivery of a series of pulses that are compensated to correspond to one or more of prescribed pulses decreases the need to record information about individual pulse characteristics to estimate the effect of a series of pulses on a target. Pulses may be prescribed by an algorithm (i.e. instructions and data stored in a memory for use by a processor or signal generator) or by data describing desired circuit configurations or electrical properties involved in pulse generation.

A prescribed pulse of current may have a duration of from about 5 microseconds to about 200 microseconds preferably from about 50 microseconds to about 150 microseconds. A prescribed series of pulses may include two or more pulses delivered at a rate of from about 10 to about 40 pulses per second, A series may continue from about 5 seconds to about 60 seconds, preferably from about 10 seconds to about 40 seconds.

System 100 includes a processor 102, a memory 103, an energy source 108, energy storage circuit 110, current delivery 112, and charge detector 120. Trigger 104 provides indicia of a trigger pull to system 100. Responsive to the trigger, system 100 may, inter alia, initiate a launch as described herein, deliver a pulse of current, and/or deliver a series of pulses of current. System 100 may further include a conventional mechanical or electronic safety mechanism or switch.

A processor directs delivery of pulses and may direct recording of delivery. Delivery of pulses may include controlling energy storage, controlling pulse formation, monitoring delivery, and adjusting operating parameters for a next pulse to be delivered. For example, processor 102 cooperates with memory 103 to record delivery. Processor 102 monitors an amount of charge delivered by a first pulse to the load. Processor 102 determines all adjustment to an amount of stored energy for a next pulse to provide a prescribed amount of charge to be delivered by the next pulse. A charge for the next pulse may be: (a) the same charge attempted to be delivered by the first pulse, (b) a charge sufficient to bring cumulative delivered charge to a prescribed amount, or (c) a charge relative to the charge actually delivered by the first pulse (e.g. a uniform charge, a charge increased or decreased by a fixed amount or by a percentage.) Processor 102 may discontinue (e.g. abort) delivery of a pulse or series of pulses.

A processor includes any circuit that performs a stored program. For example, processor 102 may include a conventional microprocessor, microcontroller, microsequencer, and/or signal processor. A processor may perform any control function described herein with reference to relative time, time of day, and/or digital or analog signals. For example, processor 102 may include a timer and an analog-to-digital converter. Timer 105 provides a reference time base for any and all control signals provided by processor 102. Timer 105 also keeps time of day and date. Signals received by processor 102 may be in any conventional digital and/or analog format. If signals are in an analog format, processor 102 may include a suitable converter, for example, analog-to-digital converter 106.

Processor 102 operates from a program stored in memory 103. In operation, processor 102 responds to a signal from trigger 104 (e.g., trigger pull) to begin or extend delivery of pulses. In response to the signal from trigger 104, processor 102 may record a delivery event in a log in memory 103. Processor 102 controls energy source 108, energy storage circuit 110, current delivery 112, and charge detection 120 as described herein and otherwise in any conventional manner.

A memory cooperates with a processor for performing any function of the processor. Memory operation includes storing program instructions retrieved and executed by the processor, and storing fixed and variable data used by the processor. For example, memory 103 primarily receives data from and provides data to processor 102. Memory 103 may also store information concerning each operation of system 100 (e.g., delivery date and time, respective goal amounts of charge, historical description of charge delivery). Memory 103 may store an algorithm or data for prescribing a pulse or series of pulses in any conventional manner. Memory includes any conventional type of semiconductor memory including programmable memory. For example, memory 103 includes circuits for ROM, RAM, and flash memory. Memory 103 and processor 102 may be formed on one substrate. System 100 may include an interface (not shown) for external access to processor 102 and/or memory 113 for exchanging information (e.g., programs, logs, time synchronization, prescribed pulse characteristics). Access may be accomplished using any conventional interface and communication protocol (e.g., wireless, internet, cell phone).

A trigger receives an external input. An external input to a trigger may be provided by a user and/or a target. A trigger may provide a signal to the processor to start or continue the desired function. For example, trigger 104 includes any circuit having a detector (e.g., switch, trip wire, beam break, motion sensor and vibration detector) for detecting an input from a user and for generating a signal received by processor 102. A trigger may initiate or control an adjusting, function of system 100.

The functional blocks of system 100 may cooperate for closed loop control. Closed loop control includes conventional feedback control technology that effects an adjustment for a future function based inter alia, upon an effect of a past performance of a related function. Trigger 104 may start or continue the function of any functional block in a loop (e.g., energy source, energy storage circuit, delivery circuit, and charge detector). Trigger 104 may start storage of a record of delivery.

An energy source provides energy to interfere with locomotion. An energy source may also provide energy to the circuits of system 100. An energy source may include any conventional circuitry for receiving, converting, and delivering energy. An energy source may deliver energy to an energy storage circuit. For example, energy source 108 may include a battery, a relaxation oscillator, and a high voltage power supply (e.g., from about 100 volts to about 50,000 volts) operated from the battery. Energy source 108 may include a voltage conversion circuit (e.g., a power supply, a transformer, a dc-to-ac converter, a dc-to-dc converter). Energy source 108 may consist essentially of a precharged capacitor (e.g., charged before launch of an electrified projectile).

In operation, energy source 108 receives start information from processor 102 to provide energy (e.g., a pulse or series of pulses) to an energy storage circuit. Energy source 108 may receive an abort signal to stop operation (e.g., responsive to a safety switch) to stop supplying energy to an energy storage circuit.

Energy source 108 may receive adjustment information (e.g., control signals) from processor 102. Adjustment information may describe any aspect of energy supply. For example, adjustment information may include information to adjust any one or more of pulse width, number of pulses, pulse rate, pulse amplitude, and/or polarity.

An energy storage circuit receives energy from a source and stores energy at the same or a different voltage as provided by the source (e.g., charges a capacitance) and provides energy from storage (e.g., discharges a capacitance) to provide a current to a load. An energy storage circuit may provide indicia of an amount of energy stored (e.g., a voltage across a capacitance). For example, storing energy in energy storage circuit 110 includes charging a capacitance. Releasing energy from energy storage circuit 110 includes discharging the capacitance. Energy storage circuit 110 provides indicia corresponding to the amount of energy presently stored. For example, signal V may provide to processor 102 at any time an indication of the extent (e.g., present amount) of stored energy. Signal V may correspond to a voltage across the capacitance discussed above. Signal V may also indicate the extent of an energy delivery function (e.g., voltage across the capacitance at any time after discharging began). Energy storage circuit 110 may include, for example one or more capacitors charged to the same or different voltages. Energy storage circuit 110 may further include one or more switches controlled by processor 102 for governing energy storage and/or release of stored energy. Energy storage circuit 110 may store energy for one pulse and release energy to form one pulse for delivery through a target. Energy storage circuit 110 may include circuits for storing and releasing energy for more than one pulse or discontinuously releasing energy for a series of pulses. Energy storage circuit 110 may include multiple capacitances, for example, one capacitance for each pulse of a series. Energy storage circuit 110 receives energy from energy source 108 and provides energy to current delivery circuit 112. Energy storage circuit 110 may provide indicia of stored charge to charge detector 120 (e.g., signal VA as discussed above).

A current delivery circuit receives energy from an energy storage circuit and releases energy into a load (e.g., a target). Electrical energy is provided as a current having voltage. Current, of course, conveys charge. A current delivery circuit may provide indicia of energy delivery to a load (e.g., measured current). Receiving energy from an energy storage circuit may include converting the energy received to a different form (e.g., higher voltage). Releasing energy may include establishing a path for the delivery of energy to a load (e.g., ionizing air in a gap), detecting whether a load is present, and detecting whether a path is formed (e.g., detecting a relatively low path resistance). Providing or releasing energy from a capacitance may include discharging the capacitance into the load or into a circuit coupled to the load.

In applications where a load is in series with a current delivery circuit, providing indicia of energy delivery to the load may include providing indicia of a current in the series circuit. Providing indicia of current may include providing a proportional current that indicates an amount of current delivered to the load. A delivery circuit may distinguish between energy used for path formation (e.g., one or more arcs) and other energy delivered to a load.

For example, current delivery circuit 112 receives energy from energy storage circuit 110, provides energy to load 114, and provides indicia of energy delivery to charge detector 120. Charge detector 120 may monitor a signal I for a period of time. Signal I indicates a current flowing in current delivery 112 for delivery to a load. By integrating signal I for the period of time, charge detector 120 provides indicia of a quantity of charge delivered through the load. Current delivery 112 may include a step-up transformer for providing an ionization voltage for path formation. Path formation may occur across one or more gaps as discussed above.

A charge detector indicates an amount of charge delivered through a load. The amount of charged delivered may be understood from analysis of signals provided to the charge detector. By detecting charge delivered, a system according to the present invention accounts for losses and variations discussed above. By accounting for losses and variations, a system according to the present invention produces in the target pulses having properties with less variation from prescribed pulse properties. Losses and variations may include losses in energy storage, current delivery circuit 112, path variability to the load, load variability, losses in a launch system if present, losses of energy from energy conversion from one form to another, imperfections in components, component property variations, transfer of energy from the system to the load, and/or variations in environmental conditions.

A charge detector may receive a signal indicating an amount of energy currently stored in an energy storage circuit. The charge detector may analyze the amount of energy stored before and after delivery to provide an indication of an amount of charge delivered through a load. A charge detector may integrate a voltage or a current for a period of time to detect an amount of charge delivered through a load. Integrating is preferred in applications where pulse shape varies.

For example, system 100 nay include circuits with only signal I, only signal V, or both signals I and V. Charge detector 120 may monitor signal I for a period of time. Signal I indicates a current flowing, in current delivery 112 for delivery to a load. By integrating signal I for the period of time, charge detector 120 provides indicia of a charge delivered to a load. Charge detector 120 may receive a signal V. Signal V indicates an amount of energy presently stored by energy storage circuit 110. By subtracting energy stored after a charging step from stored energy remaining after a discharging step, charge detector 120 computes a difference in energy and relates the difference to charge delivered to a load.

Charge detector 120 may include a subtraction circuit that indicates the difference between energy stored in energy storage circuit 110 before delivery and energy remaining in energy storage circuit 110 after delivery. The subtraction circuit may include analog technology (e.g., sample-hold) and/or digital technology.

Charge detector 120 may include a shunt in series with load 114 for monitoring a current through the load (e.g. as a voltage across the shunt) and an integrator that outputs indicia of charge as an integral or a current through the shunt. Integration of the current (or voltage) may be performed over a period that includes a duration of time before, during, and/or after delivery of a current to load 114.

Processor 102 may perform one or more of the functions of charge detector 120 by incorporating suitable signal processing technology.

System 100 may include a launcher or propellant (not shown). The launcher or propellant may propel all or a portion of system 100 toward a target (or load). For example, a portion propelled toward a target may include an electrode and a conductive tether that couples the electrode to a delivery circuit retained with the launcher. The portion propelled may include a non-tethered (e.g., wireless) projectile comprising, all or portions of energy source 108, energy storage circuit 110, current delivery circuit 112, and/or charge detector 120. In the case of a wireless projectile, providing indicia of charge delivered through the load may include wireless communication of the indicia from the projectile to circuits retained with the launcher (e.g. a base portion (not shown) of system 100).

As discussed above system 100 delivers a series of pulses of current to a load (e.g., a target). Each pulse of current delivers an amount of charge through the load. System 100, according to various aspects of the present invention, may improve the uniformity of the amount of charge delivered through a load by each pulse.

In an application for delivery of non-uniform prescribed pulses, use of system 100 may decrease the error between prescribed delivery and actual delivery.

System 100 may improve uniformity of charge delivered or reduce error by, inter alia, monitoring charge delivered through the target by a present pulse of current, comparing the charge delivered by the present pulse to an effective amount (e.g., a goal amount) of charge and adjusting the amount of charge to be delivered by a next pulse.

Monitoring an amount of charge maybe accomplished as discussed above. Comparing the charge delivered to a goal amount may be accomplished in any manner including using a processor to compare the amount of charge delivered to a goal amount of charge. Adjusting may be performed in accordance with comparing to achieve uniformity of charge delivered or reduce error by each pulse.

A pulse that delivers charge to a target may have a path formation portion and a stimulus portion. The stimulus portion may have a shape prescribed as under damped, over damped, or critically damped. Delivered pulses may vary from the prescribed shape. Adjustment to achieve uniformity or reduce error of charge delivery may be achieved by adjusting primarily the stimulus portion of a pulse.

Figure 2:
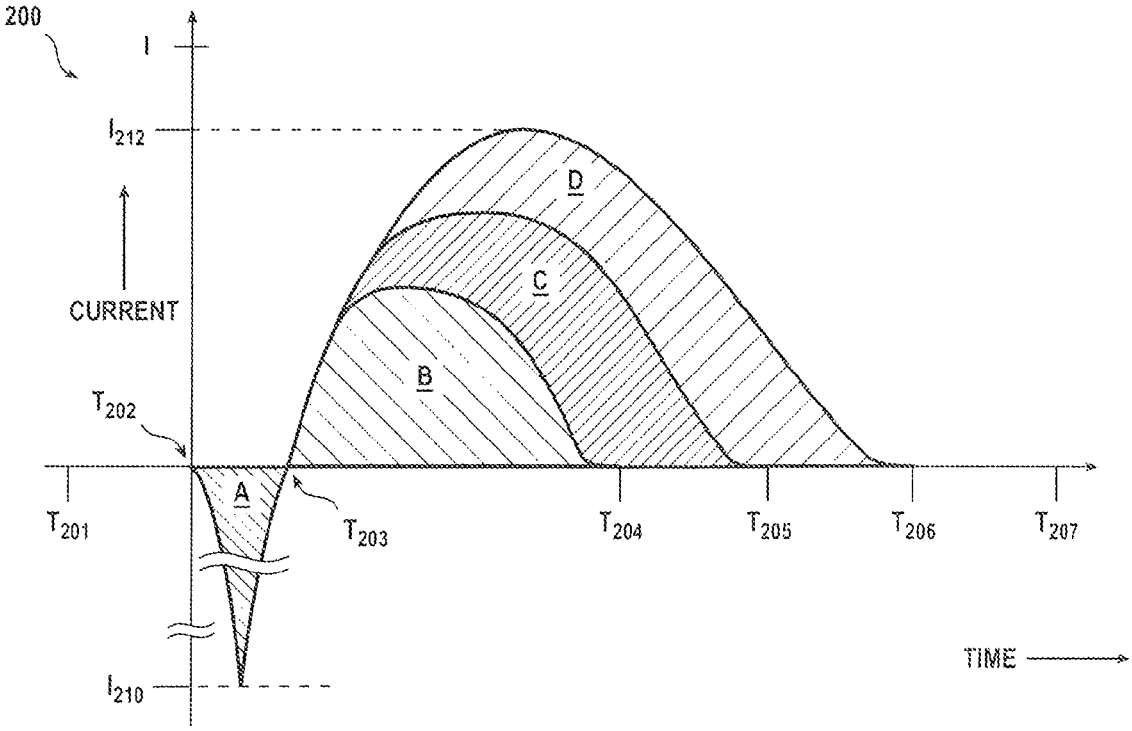
FIG. 2 is a graph of current versus time for different load conditions, according to various aspects of the present invention.
Figure 3:
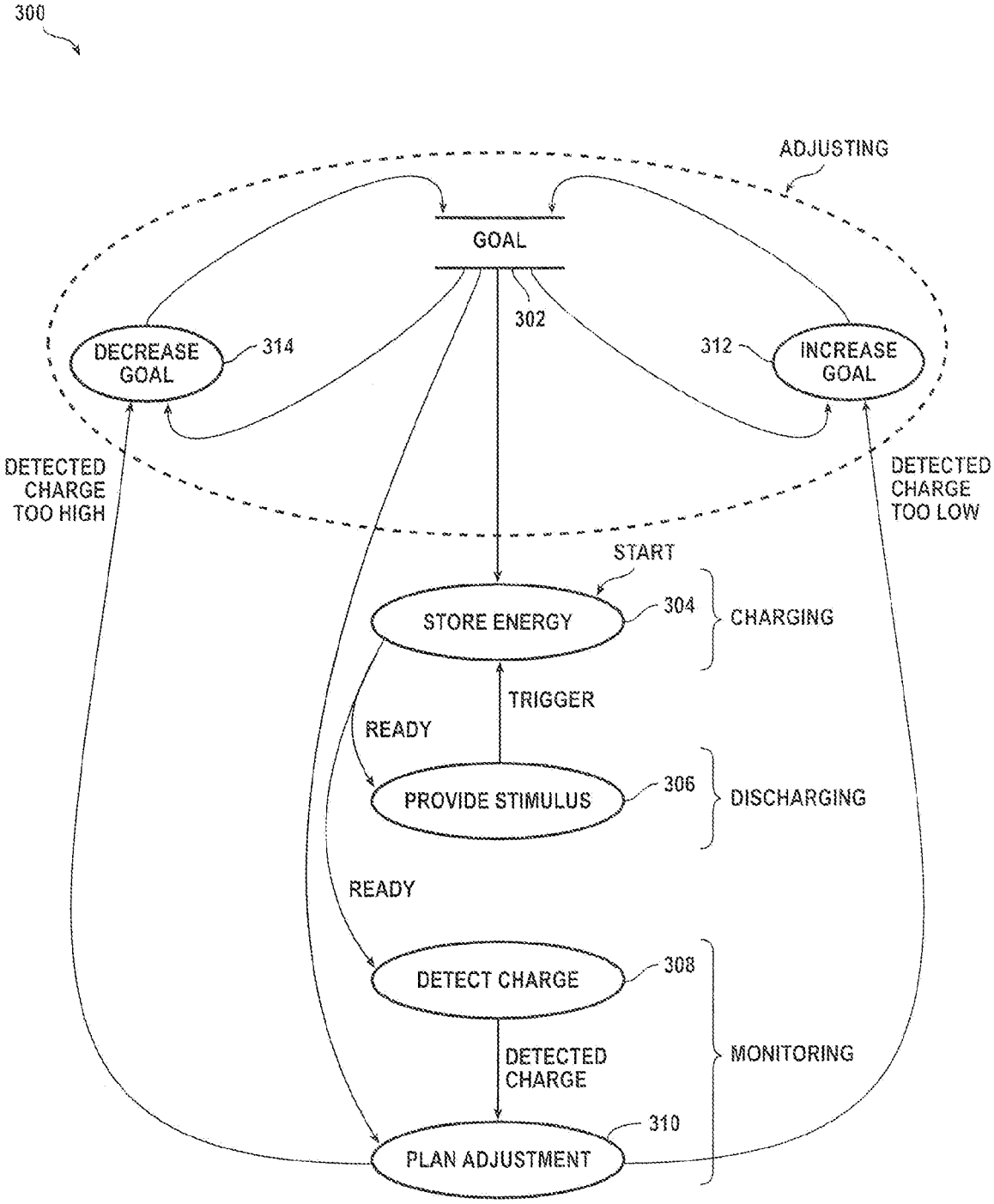
FIG. 3 is a data flow diagram of a method, according to various aspects of the present invention, for adjusting an amount of charge delivered to a load.
Figure 5:
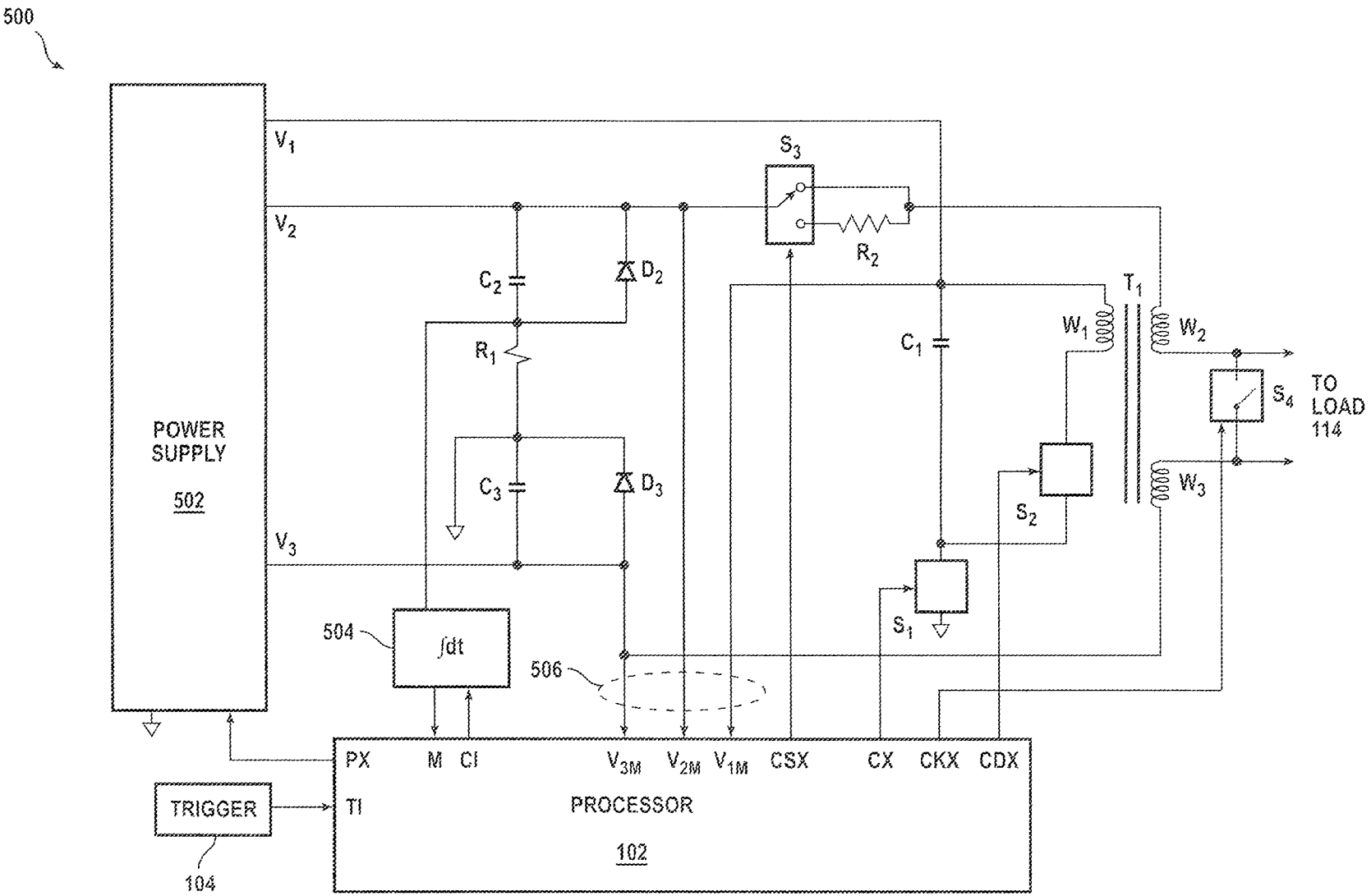
FIG. 5 is a schematic diagram of a circuit for an implementation of the apparatus of FIG. 1.

For example, FIG. 2 is a diagram of 3 pulses each having a path formation portion (A) and a stimulus portion (B, C, or D respectively). The 3 pulses are overlaid for comparison. In this example, the polarity of the path formation portion is the opposite polarity of the stimulus portion. Other polarities may be used. The stimulus portion corresponds to a critically damped pulse delivered from system 100 through load 114.

The y-axis of FIG. 2 represents current. Current 1210 represents the peak current of the path formation portion. Current 1212 represents the peak current of the stimulus portion. The absolute value of 1210 may be several orders of magnitude greater than the absolute value of 1212.

The x-axis of FIG. 2 represents time. Time T202 is an origin selected for convenience of discussion. Time T201 may correspond to a time when a trigger responds to an external input. Delivery of the path formation portion of each pulse begins at time T202 and continues until time T203. Time T203 corresponds to a start of stimulus delivery to a load. The duration of time from time T202 to time T203 may be less than about 1 microsecond for arcs of up to 2 inches (5 cm). An initial polarity reversal occurs at time T203. Times T204, T205, and T206 correspond to a time of delivery to a target of a suitable amount of stored charge (e.g., 95%).

Integration of each current pulse of FIG. 2 is indicated with cross-hatching. Integration determines the charge provided by the current for that portion of the pulse (e.g., path formation, stimulus, path formation and stimulus). For example, area A represents the integration of the current between time T202 and time T203 for a first pulse (all 3 pulses identical). Area A corresponds to an amount of charge delivered primarily during path formation. Areas B, C, and D correspond to the charge delivered from time T203 to time T104, from time T203 to time T205, and time T203 to time T206 respectively for each of the 3 pulses. Areas B, B+C, and B+C+D correspond to a respective amount of charge delivered for stimulus.

Integration may begin before time T202 and may continue after time T206 to include both a path formation and a stimulus portion of a current pulse. For example, integrating the current of FIG. 2 from time T201 to time T207 determines the charge provided for path formation and stimulus for each of the 3 pulses.

Area B represents an amount of charge delivered that is less than a desired and/or effective amount (e.g., goal amount) for a stimulus. Area B+C is an mount of charge delivered that is a desired and/or effective amount for stimulus. Area B+C+D is an amount of charge delivered that is more than a desired and/or effective amount for stimulus. Delivery of an amount of charge per pulse greater than an effective amount (e.g., area B+C+D) represents a waste of the energy provided by energy source 108. Delivery of an amount of charge less than an effective amount (e.g., area B) represents an undesirable outcome. Delivery of an effective amount of charge (e.g., area B+C) for each pulse of current corresponds to delivery of a prescribed amount of charge.

An effective amount of charge per pulse may be designed to accomplish a desired result in the target or response by the target. For example, charge less than 50 microcoulombs may be effective for pain compliance. (e.g. with pulse width of about 4 to 8 microseconds). Charge more than 50 microcoulombs to about 250 microcoulombs (preferably from about 80 microcoulombs to about 150 microcoulombs) may be effective for halting voluntary locomotion (e.g., with pulse widths of about 9 microseconds to about 1000 microseconds).

Adjusting an amount of charge to be delivered by a next pulse compensates for the above mentioned variations and losses to provide more nearly a prescribed amount of charge (e.g., area B+C) in the next pulse. Adjustment may provide a prescribed amount of charge without change to the shape of the current pulse (e.g. under damped, critically damped, over damped).

Adjusting, according to various aspects of the present invention, may include compensating on a pulse by pulse basis. For example, adjusting may include detecting an amount of charge to be delivered by an immediately preceding pulse and adjusting the amount of charge to be delivered by a next pulse to compensate for expected deviation from a prescribed next pulse.

Adjusting may include providing a next pulse on the basis of a selected prior pulse, for example selected as being a member of a trend and/or as a worst case. Adjusting may include providing a next pulse on a basis of several prior pulses in any fashion (e.g., average, mean, median, moving average, filtered). Adjusting may include monitoring charge delivered by a present pulse and stopping delivery of the present pulse upon delivery of an effective amount of charge. Adjusting may be achieved, inter alia, by adjusting an amount of energy stored for a next pulse based on an amount of charge delivered to the load by a present pulse.

For example, when an amount of charge delivered by a present pulse was about a goal amount (e.g., area B+C), the amount of energy stored for a next pulse is not adjusted. When an amount of charge delivered by a present pulse is less than a goal amount (e.g., area B), an amount of present of energy stored for a next pulse is increased. When an amount of charge delivered by a present pulse is more than a goal amount (e.g., area B+C+D), an amount of energy stored for a next pulse is decreased.

Adjusting an amount of charge delivered may be achieved, inter alia, by changing a form or amount of the energy provided by an energy source, changing a form or amount of the energy stored by an energy storage circuit, and/or changing a form or amount of the energy provided by a current delivery circuit. A form of energy may be changed by chancing a magnitude of a voltage, a magnitude of a current, an output impedance, a pulse duration, a magnitude of a pulse, a quantity of pulses, and/or a repetition rate of pulses.

For example, adjusting an amount of charge delivered may include changing an amount of energy provided by energy source 108 to energy storage circuit 110 (e.g., changing an amount of time that energy source 108 provides energy at a constant rate to energy storage circuit 110). If energy is delivered by energy source 108 to energy storage circuit 110 by pulses of energy, adjusting may include changing a quantity of pulses and/or a magnitude of pulses provided.

For example, adjusting an amount of charge delivered may include changing a conversion of energy at the input and/or output of energy storage circuit 110, all amount of energy stored (e.g., capacitance of capacitors, quantity of capacitance, extent of charging from energy source 108, and extent of discharging to current delivery circuit 112). If energy is delivered by energy storage circuit 110 to current delivery circuit 112 by pulses, adjusting may further include changing a quantity of pulses and/or a magnitude of pulses provided.

Storing energy in energy storage circuit 110 may include charging a capacitance to an adjusted stop voltage. Adjusting an amount of charge delivered may include discharging a capacitance to an adjusted stop voltage.

Adjusting an amount of charge delivered may include changing a duration of delivery of a current from current delivery circuit 112 (e.g., start or stop time that a switch is opened or closed), changing a voltage conversion (e.g., voltage multiplication), changing a duration of arc formation, changing a peak voltage of arc formation, changing a peak current delivered, and/or changing an impedance of a path of delivery to a load.

Methods performed by an apparatus according to various aspects of the present invention provide, inner alia, prescribed pulses through a load (e.g. a target), assurance that recorded events are consistent, compensation for variations in component property values, compensation for variations in load, and/or conservation of energy (e.g., reduction of wasted energy) as discussed above. Methods according to various aspects of the present invention may refer to a goal. A goal comprises one or more values, as discussed above, for example, a limit (e.g., stop voltage, stop charge, stop duration, stop time).

A method for providing pulses, according to various aspects of the present invention, may make an adjustment for a next pulse based on charge delivered by an immediately preceding pulse. Such a method may be iterative. Such a method may begin its first iteration in response to a user control for arming the apparatus (e.g., a user moves a safety switch out of a safe position). The method may repeat for each pulse of a series of pulses (e.g., one iteration 10 to 40 times per second for 5 to 60 seconds). For each iteration adjustment may be made with reference to a goal. For each iteration, energy is stored according to the adjusted goal. For example, method 300 of FIG. 3 includes store energy process 304, provide stimulus process 306, detect charge process 308, plan adjustment process 310, increase goal process 312, decrease goal process 314, and a goal 302.

Each process of method 300 may perform its function whenever sufficient input information is available. For example, processes may perform their functions serially, in parallel, simultaneously, or in an overlapping manner. A system performing method 300 may implement one or more processes in any combination of programmed digital processors logic circuits and/or analog control circuits. Inter-process communication may be accomplished in any conventional manner (e.g., subroutine calls, pointers, stacks, common data areas, messages, interrupts, asynchronous signals, synchronous signals). For example, method 300 may be performed by processor 102 that may control other functions of system 100 as discussed above. Data stored in memory 103 and revised by operation of method 300 may include goal 302.

Goal 302 may include a numeric value read and updated by method 300 to achieve prescribed (e.g., uniform) delivery of charge through a load. Goal 302 may represent a limit (e.g., a numeric quantity of, inter alia, stored energy intended for a next pulse) as discussed above. Goal 302 may be set to an initial value. The initial value may be a maximum value, a minimum value, or a mid-range value. Goal 302 may be set to account for expected losses as discussed above.

Goal 302 may include representations of one or more numeric quantities of energy, capacitance, and/or voltage describing energy storage circuit 110; one or more numeric quantities of energy, pulse repetition rate, pulse magnitude, peak voltage, and/or peak current describing energy source 108; and/or one or more quantities describing voltage conversion by energy source circuit 108, energy storage circuit 110, and/or current delivery circuit 112. Goal 302 may include configuration settings in lieu of any of the numeric quantities (e.g., for selection of capacitance, selection of transformer turns ratio, selection of limits for automatic switching, selection of pulse repetition rates).

Goal 302 may further include a set of historical values and/or quantity of attempts used for any suitable quantity of prior attempts at providing a prescribed amount of charge. Increase goal process 312 and decrease goal process 314 may use historical values to, inter alia, perform a binary search to establish a next goal, to provide hysteresis, and/or to establish margins to reduce undesirable goal changes.

For a series of different prescribed pulses, goal 302 may include a corresponding series (or algorithm) of prescriptions. Further, one goal 302 may consist of a set of values describing several aspects of one prescription.

A store energy process includes any methods for storing energy. A store energy process may store energy for forming one or more pulses. For example, store energy process 304 stores energy for one pulse and indicates a ready condition. Goal 302 may correspond to a stop voltage at which energy source 108 stops providing energy to energy storage circuit 110. Process 304 may control storing of energy in a capacitance up to a stop voltage that corresponds to goal 302; accordingly, adjusting goal 302 changes the stop voltage. Process 304 may control storing of energy up to a stop voltage in a capacitance whose capacity corresponds to goal 302; accordingly adjusting goal 302 changes the capacity of the capacitance.

Store energy process 304 may control a charging function. For example, store energy process 304 may read goal 302 and control transfer of energy from energy source 108 to energy storage circuit 110 up to an amount of energy corresponding to goal 302. As discussed above, energy storage circuit 110 may receive pulses that incrementally charge a capacitance up to a stop voltage. Charging to the stop voltage may be achieved by a suitable quantity of pulses each pulse having the stop voltage as a peak voltage (e.g., energy source 108 provides output pulses of a programmable voltage magnitude).

As another example, energy storage circuit 110 may respond to controls from store energy process 304 to provide a desired capacitance in accordance with goal 302. Store energy process 304 may retain the stop voltage used prior to the change in capacitance. As discussed above, charging to the stop voltage may be achieved by a suitable quantity of pulses each pulse having the stop voltage as a peak voltage.

As another example, store energy process 304 may control coupling of an energy source to an energy store until a limit condition is reached. The limit condition may correspond to goal 302. The condition may be a goal amount of energy or a goal duration of charging.

Upon indication that goal 302 has been met store energy process 304 may, provide a ready condition.

Store energy process 304 may begin in response to trigger 104 and/or in response to a "next" condition provided by provide stimulus process 306.

A provide stimulus process includes any method for delivering stimulus to a load to interfere with locomotion as discussed above. A provide stimulus process may include providing a stimulus signal as discussed above as one or more pulses. Such a process may further include launching and/or path formation. A provide stimulus process 306 may control a discharging function. For example, provide stimulus process 306 responds to the ready condition discussed above and begins delivery of energy stored by process 304 (e.g. after coal 302 is met). Process 306 may include discharging a capacitance of energy storage circuit 110 for delivery of a current to a load 114 by current delivery circuit 112. As discussed above, current may be delivered in one pulse for each ready condition. Process 306 may request storage of energy for another pulse by indicating a "next" condition to process 304.

A detect charge process includes any method for detecting an amount of charge delivered through a load (e.g., a target) and for providing, as a result, indicia of a quantity of charge. A detect charge process may detect an amount of charge by integrating a current and/or by subtracting voltages. For example, detect charge process 308 may begin integrating delivered current in response to the ready condition discussed above. Integration may continue for a predetermined duration. Integration may be discontinued if a result of integration is not changing more than a threshold amount per unit time. When integrating is discontinued or stopped, process 308 reports detected charge.

Detect charge process 308 nay calculate charge using a subtraction of final conditions from initial conditions indicating discharging has occurred. As discussed above, a voltage across a capacitance may indicate the final and/or initial conditions.

A plan adjustment process includes any method for determining a difference between a result of detecting and a goal. If the difference is significant, adjusting the goal is desirable. The adjustment sign and amount may be based on the sign and magnitude of the difference. Such a process may determine a difference between the charge delivered by a pulse (or series of pulses) and a goal charge per pulse (or series of pulses). For example, plan adjustment process 310 determines by subtraction the difference between an amount of charge delivered by one pulse and a charge represented by goal 302.

A plan adjustment process may convert and/or scale the result and/or the goal to common units before subtracting. For example, process 310 may calculate charge from voltage (goal 302) using the expression $Q=(½)CV^2$ where Q is charge, C is capacitance, and V is a stop voltage as discussed above. Process 310 may determine a difference between an amount of charge delivered and an effective amount of charge, while goal 302 may be expressed as an amount of energy stored for delivery.

A plan adjustment process identifies conditions. A plan adjustment process malt identify conditions for a present pulse and plan an adjustment for a next pulse. For example, process 310 detects a no arc formed condition 402 (of table 400), an under goal condition 404, an at goal condition 406, and an over goal condition 408.

A no arc formed condition 402 occurs when path formation is not successful and stimulus cannot be delivered. Process 310 detects the no arc formed condition by detecting that an amount of current delivered is less than a threshold amount. In response to the no arc formed condition, process 310 may plan no change in the amount of stored energy for stimulus. In further response to the no arc formed condition, process 410 may adjust to a goal for path formation in a manner of the type described in U.S. patent application Ser. No. 11/381,454 filed May 3, 2006 (now U.S. Pat. No. 7,457,096), incorporated herein by reference. By adjusting a goal for path formation, area A in FIG. 2 may change. Consequently, referring to FIG. 2, integration from time T202 to time T203 may indicate a different charge delivered. According to various aspects of the present invention, adjustment of charge stimulus may be responsive to a goal for path formation, a goal 302 for stimulus charge, and delivered charge (e.g., from time T201 to time T207)

An under goal condition 404 occurs when all amount of charge delivered to a load (e.g., FIG. 2 area B) is less than a desired amount. In response to the under goal condition, process 310 plans an increase in an amount of energy stored, to increase the amount of charge delivered to the load in a next pulse.

An at goal condition 406 occurs when an amount of charge delivered to a load (e.g., FIG. 2 area B+C) is about an effective amount of charge. In response to the at goal condition, process 310 plans storage of about the same amount of energy used for the present pulse for a next pulse (e.g., no change in goal 302).

An over goal condition 408 occurs when an amount of charge delivered to a load (e.g., FIG. 2 area B+C+D) is more than an effective amount of charge. In response to the over goal condition, process 310 plans a decrease in an amount of energy stored, to decrease the amount of charge delivered to the load in a next pulse.

Goal 302 at the first iteration of method 300 mast effect storage of a maximum energy. In this case, process 310 in subsequent iterations for a series of pulses decreases the goal toward a desired goal value. The first pulses may be desired to be relatively maximum pulses.

Goal 302 at the first iteration of method 300 may effect storage of a minimum energy for energy conservation. Process 310 thereafter increases goal 302 toward a desired value for a series of pulses. Goal 302 may be set for a midrange value prior to the first iteration for unpredictable delivery conditions.

Table 400 proposes adjustments in an amount of energy stored that both increase and decrease the amount stored for a next pulse. Process 310 may propose not only a direction of energy storage chance (e.g., increase, decrease, no change), but also an amount of energy storage change. An amount of change may be the same as the amount of a previous change or an amount that varies with each performance of process 310 (e.g., binary search). An amount of change may be determined by process 310, process 312, and/or process 314.

Detect charge process 308 and determine difference process 310 cooperate to perform a monitoring function. Monitoring may include using charge detector 120 and processor 102 to detect an amount of charge delivery through a load by current delivery circuit 112.

An increase goal process determines one or more values or sets of values for a goal (or set of goals) that correspond generally to an increase of a goal. For examples, process 312 modifies goal 302 responsive to process 310 determining that an amount of charge delivered is less than an effective amount. Process 312 may determine an amount of increase and/or implement an amount of increase proposed by process 310. As discussed above, an amount of increase may vary with each performance.

A decrease goal process determines one or more values or sets of values for a goal (or set of goals) that correspond generally to a decrease of a goal. For example, process 314 modifies goal 302 responsive to process 310 determining that an amount of charge delivered is more than an effective amount. Process 314 may determine an amount of decrease and/or implement an amount of decrease proposed by process 310. As discussed above, an amount of decrease may vary with each performance.

Increase goal process 312 and decrease goal process 314, cooperate to perform an adjusting function.

Implementations of the functions described above with reference to FIGS. 1-5 may include a power supply for providing energy (e.g., programmable, switched-mode, battery), capacitors for storing energy (e.g. capacitors for path formation and/or stimulus), switches (e.g., spark (gap components, semiconductor switches, transistors (IGBJTs), rectifiers (SCRs)), transformers for energy conversion (e.g., voltage step up), controllers for controlling processes, an integrator for detecting a charge, a shunt circuit for detecting a current provided through a load, and a trigger for initiating or continuing operation. For example, circuit 500 of FIG. 5 implements a system according to various aspects of the present invention as discussed above.

Functions of energy source 108 are provided by power supply 502 and processor 102. Power supply 502 is a programmable power supply that charges path formation capacitor Cl and charges stimulus capacitors C2 and C3. Processor 102 controls charging by monitoring signals V1M, V2M, and V3M and directing power supply 502 (e.g., via signal PX) to discontinue charging when a respective limit condition is reached (e.g., a stop voltage indicated by signal one or more of signals V1M, V2M, and V3M).

Functions of energy storage circuit 110 are provided by path formation capacitor Cl, switches S1 and S2, stimulus capacitors C2 and C3, and processor 102. Processor 102 closes switch S1 and opens switch S2 to charge capacitor Cl.

Before target 114 completes a circuit with the secondary windings W2 and W3 of transformer T1 (or before an arc is formed to complete the circuit with or without a target), capacitors C2 and C3 may be charged.

Functions for current delivery circuit 112 are provided by transformer T1, switches S1 and S2, capacitors C1, C2, C3, diodes D2 and D3, and shunt resistor R1. Transformer T1 has one primary winding W1 and two secondary windings W2 and W3. After charging, capacitors C1, C2, and C3 and when a stimulus current is to be delivered, processor 102 opens switch S1 and closes switch S2 to start current flow from capacitor C1 into primary winding W1. Current in winding W1 induces a current in secondary windings W2 and W3 at a voltage sufficient to form an arc (e.g., ionize air in a gap) to establish a path through load 114 (e.g., a target). The arc permits current to discharge from capacitors C2 and C3 through load 114. Energy stored in capacitor C1 is released by discharging capacitor C1. A portion of the energy released is temporarily stored by transformer T1 as a magnetic field. After capacitor C1 substantially discharges, the magnetic field of transformer T1 collapses. The collapsing magnetic field releases this energy to continue the current through windings W2 and W3, target 114, D3, R1, and D2. Shunt resistor R1 is in series with the load. Diodes D2 and D3 provide a bypass circuit around capacitors C2 and C3 respectively, especially for conducting current continued by the collapsing magnetic field of secondary windings W2 and W3. Accordingly, the current that flows through the load also flows through resistor R1 providing a signal proportional to current for integration over time. Energy of the collapsing magnetic field (monitored by monitoring the current) consequently contributes to the charge delivered through the target.

Functions for charge detector 120 are provided by integrator 504, processor 102 and the series circuit through the target that includes, inter alia, resistor R1 and diodes D2 and D3. As discussed above, processor 102 may detect voltage values after a charging function and a discharging function for detecting an amount of current delivered. Doing so does not account for the substantial energy delivered by the collapsing magnetic field discussed above. Integrator 504 outputs indicia of an amount of charge delivered through load 114 to processor 102. Processor 102 controls operation of integrator 504 (e.g., via signal CI).

Processor 102 performs method 300. Conventional signal conditioning circuitry (not shown) may scale signals 506.

Release of energy may be discontinued with reference to a goal (e.g. a goal referring to a prescribed amount of charge per pulse). Discontinuing release of energy consequently discontinues delivery of substantial charge through the target. Delivery may be discontinued by a processor and switches. For example, at any time, processor 107 in response to integrator 504 may determine that a goal amount of charge delivered through the target has been or will be exceeded (e.g., FIG. 2 at time T204 for reducing area D). Discontinuing may be accomplished by shunting the target (e.g., closing the normally open switch S4 of FIG. 5). Discontinuing may also be accomplished by mismatching the output impedance of a current delivery circuit and the target impedance. For example, processor 102 may add resistance in series with a secondary winding that is providing current through a target (e.g., by setting switch S3 to include resistor R2).

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A method performed by an apparatus, the apparatus for interfering with voluntary locomotion by a target by conducting a current through the target, the method comprising:

charging a capacitance in accordance with a goal;

discharging the capacitance to provide the current, wherein the current causes pain or skeletal muscle contractions that interfere with voluntary locomotion by the target;

monitoring a charge of the current; and in response to monitoring, adjusting the goal.

2. The method of claim 1 wherein discharging comprises forming a magnetic field that later collapses to continue the current.

3. The method of claim 1 wherein the goal comprises a voltage of the capacitance at which charging is complete.

4. The method of claim 1 wherein the goal comprises a duration upon lapse thereof charging is complete.

5. The method of claim 1 wherein adjusting comprises increasing the goal.

6. The method of claim 1 wherein adjusting comprises decreasing the goal.

7. The method of claim 1 wherein the goal comprises a quantity of pulses for charging.

8. The method of claim 1 wherein a result of monitoring comprises indicia of a quantity of the charge.

9. The method of claim 1 wherein:

monitoring comprises integrating the current; and a result of monitoring comprises indicia of a quantity of charge.

10. The method of claim 1 wherein:

the current comprises a series of pulses; and the method further comprises adjusting the goal for each pulse of the series.

11. The method of claim 1 wherein the goal comprises a quantity of charge delivered through the target.

12. A method performed by an apparatus, the apparatus for interfering with voluntary locomotion by a target by conducting a current through the target, the method comprising:

charging a capacitance;

discharging the capacitance in accordance with a goal to provide the current, wherein the current causes pain or skeletal muscle contractions that interfere with voluntary locomotion by the target;

monitoring a charge of the current; and in response to monitoring, adjusting the goal.

13. The method of claim 12 wherein discharging comprises forming a magnetic field that later collapses to continue the current.

14. The method of claim 12 wherein the goal comprises a voltage of the capacitance at which discharging is complete.

15. The method of claim 12 wherein the goal comprises a duration upon lapse thereof discharging is complete.

16. The method of claim 12 wherein adjusting comprises increasing the goal.

17. The method of claim 12 wherein adjusting comprises decreasing the goal.

18. The method of claim 12 wherein the goal comprises a quantity of charge delivered through the target.

19. The method of claim 12 wherein a result of monitoring comprises indicia of a quantity of the charge.

20. The method of claim 12 wherein:

monitoring comprises integrating the current; and a result of monitoring comprises indicia of a quantity of the charge.

21. The method of claim 12 wherein:

the current comprises a series of pulses; and the method further comprises adjusting the goal for each pulse of the series.

22. An apparatus for interfering with locomotion of a target by conducting a current through the target, the apparatus comprising:

a transformer having a secondary winding, the secondary winding coupled to the target to provide the current;

a capacitance in series with the secondary winding;

a detector that detects a quantity of charge provided through the target by the capacitance and the secondary winding; and a processor that controls recharging of the capacitance in response to the detector.

23. The apparatus of claim 22 wherein the detector comprises an integrator.

24. The apparatus of claim 22 wherein the detector comprises a shunt in series with the secondary winding.

25. The apparatus of claim 22 further comprising a diode that allows the current to bypass the capacitance.

26. The apparatus of claim 22 further comprising:

a second capacitance, in series with a primary winding of the transformer, for establishing an ionization of air in a gap for delivering the current.

27. The apparatus of claim 22 further comprising a trigger wherein the processor controls charging of the capacitance in response to the trigger.

28. A memory for a processor, the memory comprising:

indicia of a prescribed series of pulses; and instructions for the processor to perform, in accordance with the indicia of the prescribed series, a method for interfering with voluntary locomotion by a target by conducting a current through the target, the method including:

charging a capacitance in accordance with a goal;

discharging the capacitance to provide the current, wherein the current causes pain or skeletal muscle contractions that interfere with voluntary locomotion by the target;

monitoring a charge of the current; and in response to monitoring, adjusting the goal.

29. The memory of claim 28 further comprising:

a log that records a date and a time of delivery of the current.

30. The memory of claim 28 wherein instructions for performing the method implements closed loop control.

31. A memory for a processor, the memory comprising instructions for the processor to perform a method for interfering with voluntary locomotion by a target by conducting a current through the target, the method including:

charging a capacitance in accordance with a goal;

discharging the capacitance to provide the current, wherein the current causes pain or skeletal muscle contractions that interfere with voluntary locomotion by the target;

monitoring a charge of the current; and in response to monitoring, adjusting the goal.

32. A memory for a processor, the memory comprising:

indicia of a prescribed series of pulses; and instructions for the processor to perform, in accordance with the indicia of the prescribed series, a method for interfering with voluntary locomotion by a target by conducting a current through the target, the method including:

charging a capacitance;

discharging the capacitance in accordance with a goal to provide the current, wherein the current causes pain or skeletal muscle contractions that interfere with voluntary locomotion by the target;

monitoring a charge of the current; and in response to monitoring, adjusting the goal.

33. The memory of claim 32 further comprising:

a log that records a date and a time of delivery of the current.

34. The memory of claim 32 wherein instructions for performing the method implements closed loop control.

35. A memory for a processor, the memory comprising instructions for the processor to perform a method for interfering with voluntary locomotion by a target by conducting a current through the target, the method including:

charging a capacitance;

discharging the capacitance in accordance with a goal to provide the current, wherein the current causes pain or skeletal muscle contractions that interfere with voluntary locomotion by the target;

monitoring a charge of the current; and in response to monitoring, adjusting the goal.

* * * * *

UNITED STATES PATENT AND TRADEMARK OFFICE

CERTIFICATE OF CORRECTION

PATENT NO. : 7,821,766 B2
APPLICATION NO. : 11/737374
DATED : October 26, 2010
INVENTOR(S) : Steven N. D. Brundula It is certified that error appears in the above-identified patent and that said Letters Patent is hereby corrected as shown below:

In column 1, line 50, after "capacitance" delete "," and insert -- ; --, therefor.

In column 2, line 2, after "invention" insert -- , --.

In column 2, line 6, delete "DRAWINGS" and insert -- DRAWING --, therefor.

In column 2, line 31, delete "May" and insert -- may --, therefor.

In column 2, line 54, after "Disrupting" delete ",".

In column 2, line 57, delete "though" and insert -- through --, therefor.

In column 3, line 63, after "second" delete "," and insert -- . --, therefor.

In column 4, line 14, delete "all" and insert -- an --, therefor.

In column 4, line 63, delete "113" and insert -- 103 --, therefor.

In column 5, line 6, after "sensor" insert -- , --.

In column 5, line 8, after "adjusting" delete ",".

In column 5, lines 62-67 and column 6 lines 1-9, after "began)." delete "Energy storage circuit 110 may include.....as discussed above)." and insert the same as a continuation of new paragraph in column 5, line 61.

In column 6, line 8, after "signal" delete "VA" and insert -- V --, therefor.

In column 7, line 1, delete "nay" and insert -- may --, therefor.

In column 7, line 22, delete "or" and insert -- of --, therefor.

In column 7, line 42, after "above" insert -- , --.

In column 7, line 55, after "charge" insert -- , --.

In column 8, line 11, delete "1210" and insert -- I210 --, therefor.

In column 8, line 13, delete "1212" and insert -- I212 --, therefor.

In column 8, line 14, delete "1210" and insert -- I210 --, therefor.

In column 8, line 15, delete "1212" and insert -- I212 --, therefor.

Signed and Sealed this
Eleventh Day of October, 2011

David J. Kappos

David J. Kappos
*Director of the United States Patent and Trademark Office*

In column 8, line 36, delete “T104” and insert -- T204 --, therefor.

In column 8, line 48, delete “mount” and insert -- amount --, therefor.

In column 9, line 30, after “amount of” delete “present of”.

In column 9, line 40, delete “chancing” and insert -- changing --, therefor.

In column 9, line 54, delete “all” and insert -- an --, therefor.

In column 10, line 7, delete “inner alia” and insert -- inter alia --, therefor.

In column 10, lines 38-39, after “processors” insert -- , --.

In column 11, line 50, after “met” insert -- , --.

In column 11, line 64, delete “coal” and insert -- goal --, therefor.

In column 12, line 16, delete “nay” and insert -- may --, therefor.

In column 12, line 42, delete “malt” and insert -- may --, therefor.

In column 12, line 65, delete “all” and insert -- an --, therefor.

In column 13, line 16, delete “mast” and insert -- may --, therefor.

In column 13, line 21, delete “effect” and insert -- affect --, therefor.

In column 13, line 30, delete “chance” and insert -- change --, therefor.

In column 13, line 65, delete “spark (gap” and insert -- spark gap --, therefor.

In column 14, line 10, delete “Cl” and insert -- C1 --, therefor.

In column 14, line 17, delete “Cl” and insert -- C1 --, therefor.

In column 14, line 19, delete “Cl” and insert -- C1 --, therefor.

In column 15, line 3, delete “107” and insert -- 102 --, therefor.